US006135635A

United States Patent [19]

Miller et al.

[11] Patent Number: 6,135,635

[45] Date of Patent: Oct. 24, 2000

[54] CONVERTIBLE BAG AND BARRIER DEVICE

[76] Inventors: Jeffrey Miller; Trevor Toppen, both of 2333 W. Saint Paul Ave., Apt. 206, Chicago, Ill. 60647

[21] Appl. No.: 09/415,049

[22] Filed: Oct. 7, 1999

[51] Int. Cl.[7] ..... B65D 30/10

[52] U.S. Cl. ..... 383/2; 383/4; 297/229; 224/584; 5/419

[58] Field of Search ..... 383/2, 4, 6, 110; 224/584, 585, 275; 297/229, 188.06, 228.11; 5/417, 419; 150/154, 158

[56] References Cited

U.S. PATENT DOCUMENTS

| | | | |
|---|---|---|---|
| 2,450,040 | 9/1948 | Gibson | 383/2 |
| 3,029,852 | 4/1962 | Taylor | 383/2 |
| 4,273,380 | 6/1981 | Silvestri | 297/229 X |
| 4,302,046 | 11/1981 | Lazazzero | 297/229 X |
| 4,725,094 | 2/1988 | Greer | 297/229 |
| 4,877,288 | 10/1989 | Lee | 297/229 |
| 4,892,353 | 1/1990 | Goddard | 297/229 |
| 5,072,467 | 12/1991 | Hunt | 5/417 |
| 5,150,945 | 9/1992 | Aupperlee et al. | 297/229 |
| 5,199,120 | 4/1993 | Holmes | 5/419 |
| 5,503,456 | 4/1996 | Rossini | 224/584 X |
| 5,584,422 | 12/1996 | Bond-Madsen | 383/4 X |
| 5,620,229 | 4/1997 | Ledford | 297/229 |
| 5,641,199 | 6/1997 | Bond-Madsen | 383/4 X |
| 5,843,556 | 12/1998 | Levas | 383/4 X |

FOREIGN PATENT DOCUMENTS

| | | | |
|---|---|---|---|
| 2704401 | 11/1994 | France | 383/4 |

*Primary Examiner*—Jes F. Pascua
*Attorney, Agent, or Firm*—McHale & Slavin

[57] ABSTRACT

A adjustably-sized convertible bag, cover and protective barrier device includes a primary, barrier panel construction and a secondary, pouch-forming construction. The secondary panel construction is attached to the primary panel construction, and the panel constructions cooperatively form a scoop-like cap adapted to engage the upper portion of a seat. The device may be folded into several orientations: a bag orientation having an adjustable main interior compartment; a seat cover orientation adapted to adjustably engage the upper portion of a seat; and a mat construction adapted to allow an individual to rest upon various surfaces without becoming wet, dirty, or sandy.

13 Claims, 4 Drawing Sheets

CONVERTIBLE BAG AND BARRIER DEVICE

FIELD OF THE INVENTION

This invention is directed to convertible bags and, in particular, to a bag or backpack that selectively maintains an adjustable equipment-transporting orientation, a seat cover orientation, and a mat orientation.

BACKGROUND OF THE INVENTION

There are many activities, such as trips to the beach, outings to parks or other outdoor venues, and attendance at or participation in sporting events, that require an individual to bring specialized equipment to and from remote locations. These same activities also often present situations in which individuals may become wet and may involve locations in which individuals would desire a mat or other item upon which to rest.

Trips to the beach, for example, often involve the use and transport of sunscreen, towels, picnic supplies, and assorted water toys and floats. While at the beach, many individuals will get wet by venturing into adjacent water for a swim or simply to cool off. Some individuals enjoy sleeping or reclining while at the beach and will bring a blanket or mat on which to relax without becoming sandy. During a trip home from the beach, individuals are often wet, sandy, or both and many who travel by automobile will sit on a towel in an attempt to protect the underlying seat. As a result, trips to the beach often require a bag to transport needed items, a blanket on which to rest, and several towels for drying purposes and for use as protective seat covers.

Outings to parks and other outdoor venues present equipment requirements, as well. For example, many individuals will bring reading material or picnic supplies to these locations. Some individuals will choose to enjoy nature by sitting or napping under shady trees or in a field. Still others will listen to a concert or watch a play. These activities often lend themselves to resting upon a blanket or mat spread out to protect individuals from unwanted contact with dew or dirt commonly encountered in outdoor settings. On warm days, this type of outing may make some individuals sweaty, inviting the use of a towel or other barrier to prevent damage to an underlying automobile seat during travel home.

Attending or participating in sporting events also presents logistical hurdles. Personal participation in sporting events requires, in most cases, transportation of specialized equipment, such as bats, balls, gloves, pads, or helmets. Even many spectator sports involve the use of equipment, including binoculars, seat cushions, mats on which to rest, and various spirit-promoting paraphernalia. Some events, such as swim events will, almost by definition, require participants to become wet. Other events will make participants sweaty from exertion. Even spectator events can make many individuals sweaty from heat on warms days. As a result, sporting event participants and spectators will often use a bag to transport equipment to and from the event and will, in many cases, require several towels for drying purposes and for use as barriers to protect underlying car seats during drives home from the event.

Several devices exist to help meet the needs of individuals who pursue these types of activities. U.S. Pat. No. 5,843,556, for example, discloses a multipurpose beach towel, tote bag, and chair cover device. The '556 device is convertible between a beach towel, a tote bag, a deck chair cover, and an automobile seat cover. However, although this device may be suitable for some situations, the tote bag formed has a relatively fixed size and is not readily modifiable to accommodate large or bulky items. Additionally, although the '556 device may be used as a deck chair cover or as a cover for some automobiles, the '556 device does not include provisions for easy size adjustment and securement to oversized or small seats.

U.S. Pat. No. 5,641,199 discloses a combination backpack and chair cover. The '199 device includes a collection of strategically hinged panels and interlocks that allow the device to alternately adopt an open, seat-covering orientation and a closed, backpack-forming orientation. The '199 device may be suitable for some situations, but the backpack orientation provided thereby has a fixed size and shape, making it unsuitable for use with large or bulky items. Additionally, although the '199 device is useful for covering some slatted chairs, the '199 device is not readily securable to automobile seats.

U.S. Pat. No. 4,725,094 discloses an expandable terry cloth sand or lawn chair cover having integrated pockets. The '094 device will cover several types of chairs and includes pockets to hold small items. However, the '094 device will not hold large or bulky items and does not convert to a bag that may be used to export items to and from remote locations.

Thus, what is needed is an adjustably-sized, convertible bag or backpack and protective barrier device that includes advantages of the known devices, while addressing the shortcomings they exhibit. The device should allow an individual to bring a large number of items to and from remote locations, enable individuals to relax on damp or sandy surfaces without getting wet, and provide an absorbent, moisture-repellent barrier that protects automobile seats during travel. The device should provide an adjustably-sized main interior compartment that allows the device to accommodate large or elongated items, if needed. The device should provide interchangeable groups of component pouches or pockets into which various groups of related items may be inserted for simultaneous attachment or removal. The device should also include a rolled section into which delicate items may be placed and protected during transit. The device should also include provisions to allow adjustable, secure attachment to seats having a variety of sizes.

SUMMARY OF THE INVENTION

The instant invention is a convertible bag or backpack and protective barrier device. The device includes a primary, barrier panel construction that cooperates with a secondary, pouch-forming panel construction. The barrier panel construction includes an absorbent surface and an opposite moisture-repellent surface. The pouch-forming panel construction includes a pair of fabric panels secured together to form compartments or pouches between the fabric panels. The secondary panel construction is releasably attached to the primary panel construction to form a scoop-like cap sized and shaped to engage the upper portion of a seat. The secondary panel construction is releasably secured to the primary panel construction, and the secondary panel construction forms a collection of pouches or compartments that may include groups of related items that may be attached or removed as a set.

In a bag or backpack orientation, the primary and secondary panel constructions may be cooperatively folded into a tube, or sleeve-like orientation. In this orientation, the tube or sleeve creates a main internal compartment, with one end of the tube being adjustably rolled or otherwise manipulated to form the floor of the main compartment. An included flap may be used to close the top of the main internal compartment.

In a mat orientation, the panel constructions are no longer in a sleeve-like orientation, but are placed in a relatively-flat orientation. In this orientation, an individual may place the device against various surfaces without fear of becoming wet, sandy, or dirty.

In a seat cover orientation, the cap of the scoop-like cap of the device is used to engage the upper, headrest portion of a seat. Included straps advantageously allow selective size adjustment of the scoop-like cap to cinch the device against the selected seat's upper portion.

The device also includes shoulder straps and a handle strap to allow easy transportation of the device to and from remote locations.

Thus it is an objective of the instant invention to provide an adjustably-sized, convertible bag or backpack and protective barrier device that allows an individual to bring a large number of items to and from remote locations, enables individuals to relax on damp or sandy surfaces without getting wet, and provides an absorbent, moisture-repellent barrier for protecting automobile seats during travel.

An additional objective of the present invention is to provide an adjustably-sized, convertible backpack and protective barrier device that includes an adjustably-sized main compartment, thereby allowing the device to accommodate large or bulky items.

Yet another objective of the present invention is to provide an adjustably-sized, convertible backpack and protective barrier device that includes interchangeable groups of component pouches or pockets into which various groups of related items may be inserted for simultaneous attachment or removal.

Still a further objective of the present invention is to provide an adjustably-sized, convertible backpack and protective barrier device that includes a rolled section into which delicate items may be placed and protected during transit.

An additional objective of the present invention is to provide an adjustably-sized, convertible backpack and protective barrier device that includes provisions to allow adjustable, secure attachment to seats having a variety of sizes.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
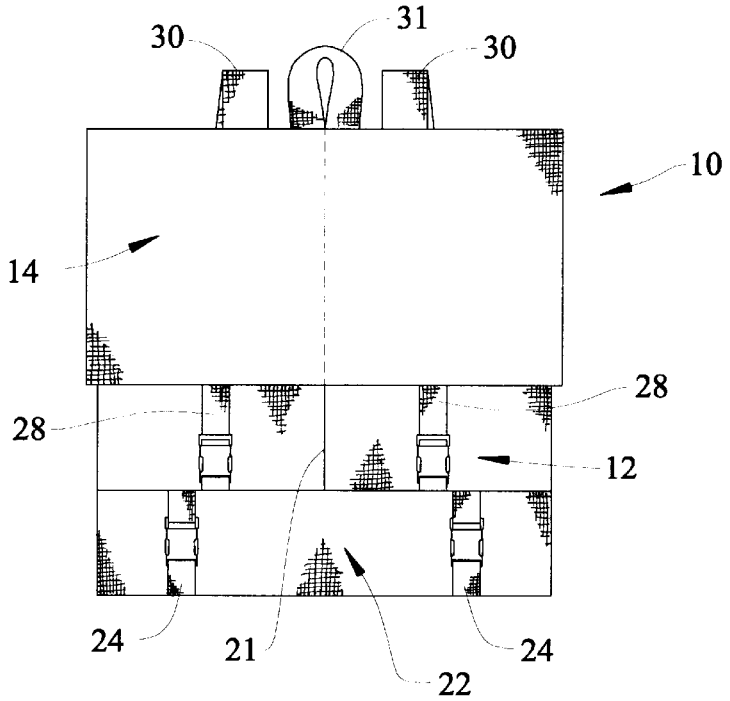
FIG. 1 is a pictorial view of the convertible bag and barrier device of the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
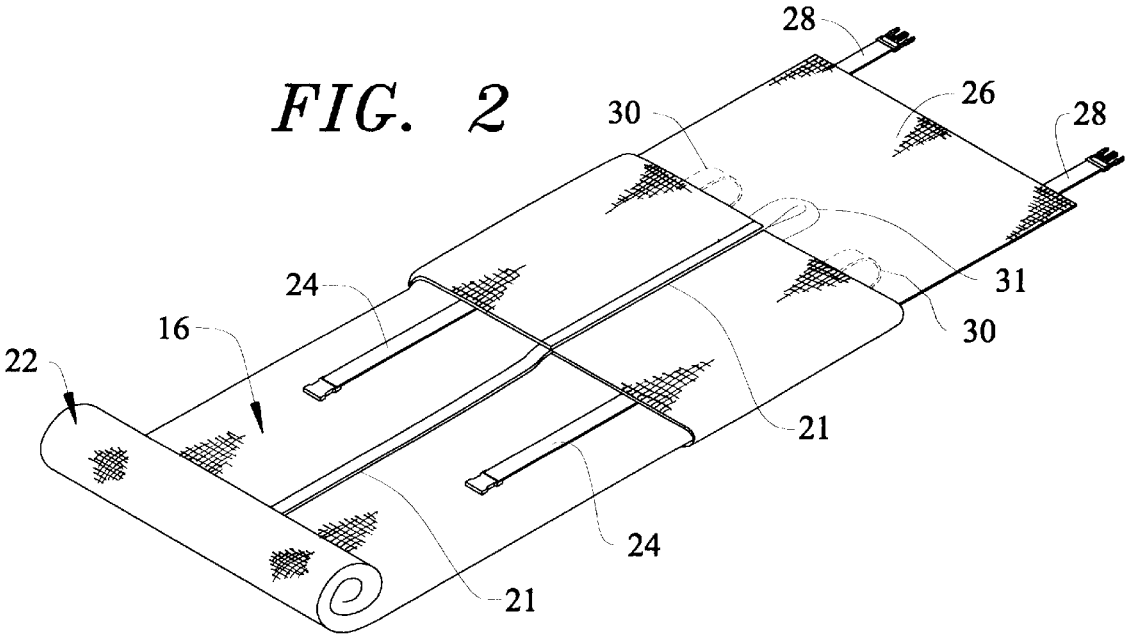
FIG. 2 is a pictorial view of the instant invention, shown in partially-rolled sleeve orientation.
Figure 2A:
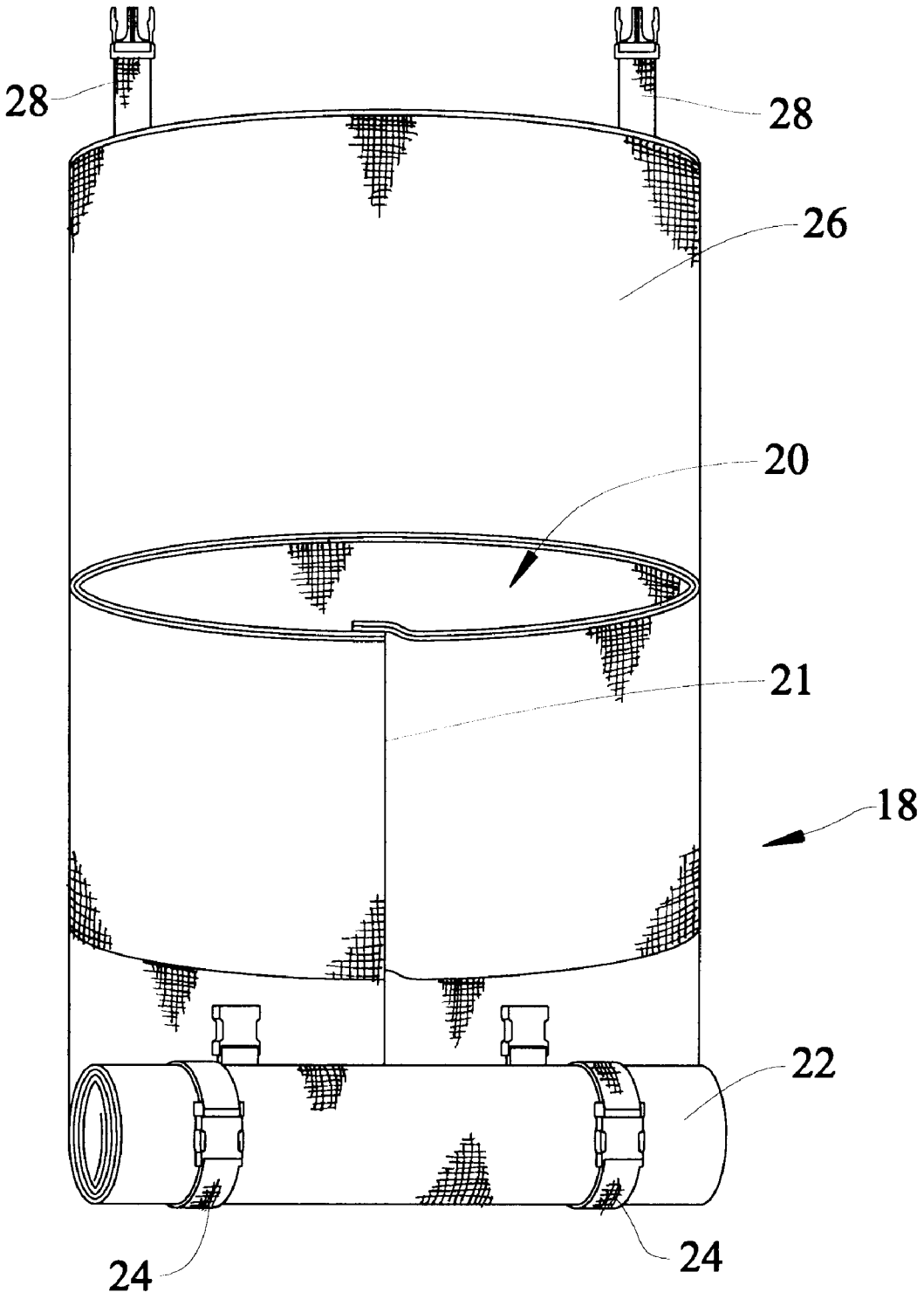
FIG. 2A is a pictorial view of the instant invention, shown in backpack orientation, with a flap panel open.

Now with respect to FIGS. 1, 2, and 2A, the adjustably-sized, convertible bag or backpack and barrier device 10 of the present invention is shown. By way of overview, the device 10 includes a primary panel, barrier construction 12 releasably secured to a secondary. Panel construction 14. The primary panel construction 12, as will be described more fully below, may be folded in an overlapping manner, to form an elongated sleeve 16. The secondary panel construction 14 cooperates with the primary panel construction 12 to help selectively maintain the primary panel construction in the elongated sleeve orientation 16. Once secured in the elongated sleeve orientation 16, the primary panel construction 12 may be rolled longitudinally to form a backpack 18 having a main internal compartment 20 that is adjustably sized and bounded on the bottom by the rolled portion 22 of the primary panel construction 12. The rolled portion 22 is selectively held in place by adjustable roll-securing straps 24. With continued reference to FIGS. 2 and 2A, the secondary panel construction 14 includes a flap panel 26 that selectively covers the main compartment 20. The flap panel 26 is releasably secured via adjustable flap-securing straps 28 and may include a pocket, not shown. As will be described more fully below, the device 10 includes adjustable shoulder straps 30 which allow an individual to carry the device on his shoulders. The device 10 also includes a handle strap 31 that allows single-handed grasping. The details of the device 10 will now be discussed.

Figure 3:
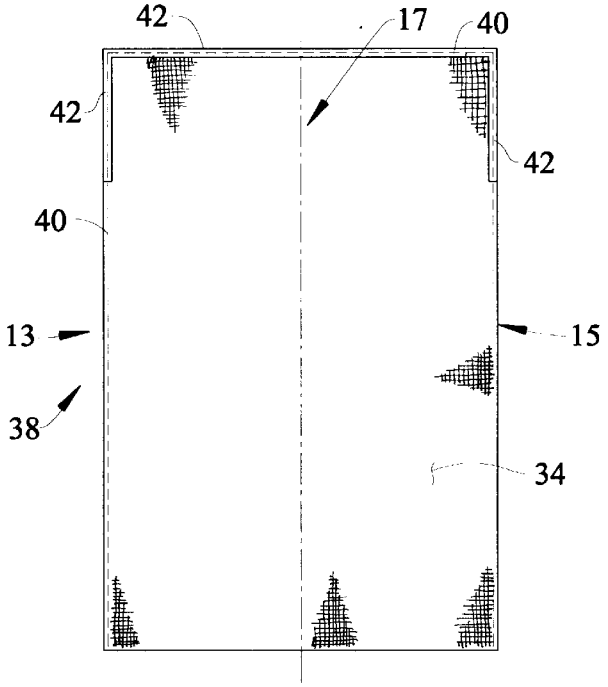
FIG. 3 is an plan view of the moisture-repellent surface of the primary, barrier panel construction of the present invention.
Figure 4:
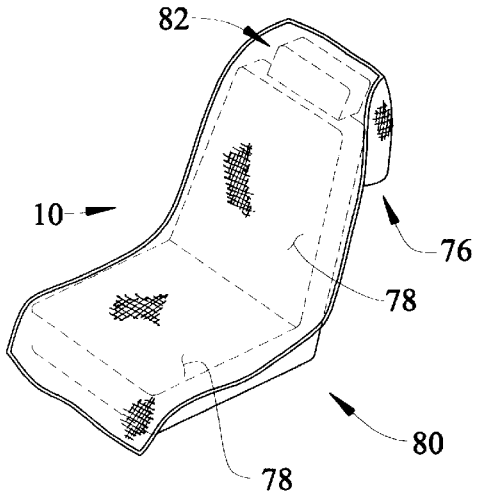
FIG. 4 is a pictorial view of the present invention shown in a seat-covering orientation.
Figure 4A:
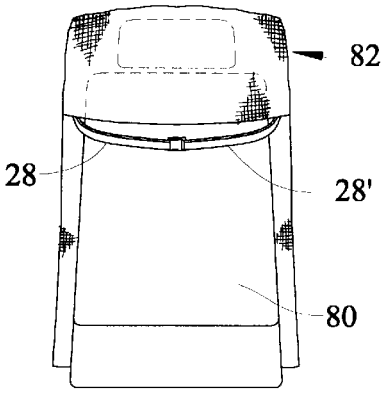
FIG. 4A is a close-up rear view of the seat-covering orientation of the present invention.
Figure 5:
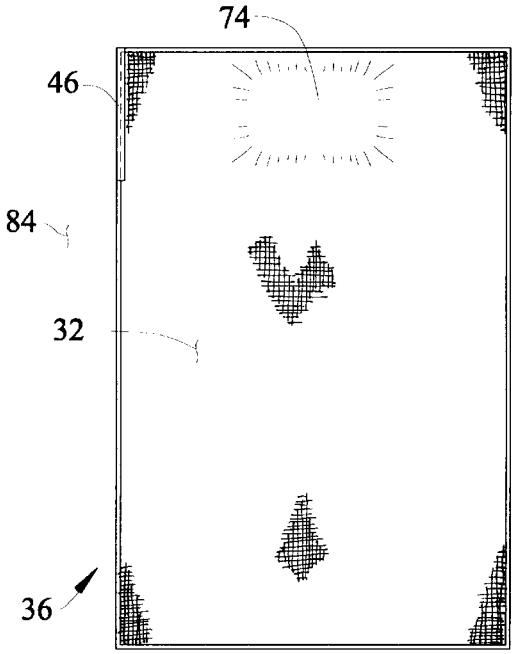
FIG. 5 is a pictorial view of the present invention shown in a mat-forming orientation.

With reference to FIGS. 3 and 5, the primary panel or barrier construction 12 resembles a flexible, rectangular mat having an absorbent surface 32 and an opposite, moisture-repellent surface 34. The absorbent surface 32 wicks moisture away from an individual using the device 10, and the moisture-repellent surface 34 prevents liquids from passing through the device 10. With this arrangement, the device may be used as a seat cover, as shown in FIGS. 4 and 4A, or as a mat for placement against dirty, sandy, or wet surfaces, as shown in FIG. 5.

With continued reference to FIGS. 3 and 5, the barrier construction 12 is preferably a two-panel assembly that includes a first panel 36 made from terry cloth or similar absorbent material and a second panel 38 attached thereto; in this manner, the first panel may also provide insulation for items placed within the main compartment 20. The second panel 38 is made from nylon or other similar moisture-repellent material. Although the first and second panels 36,38 are preferably attached by stitching 40, other connection means may be used, including adhesives and releasable fastener material, such as that available under the trademark VELCRO. The barrier construction 12 may also be made from one panel of treated material.

Figure 7:
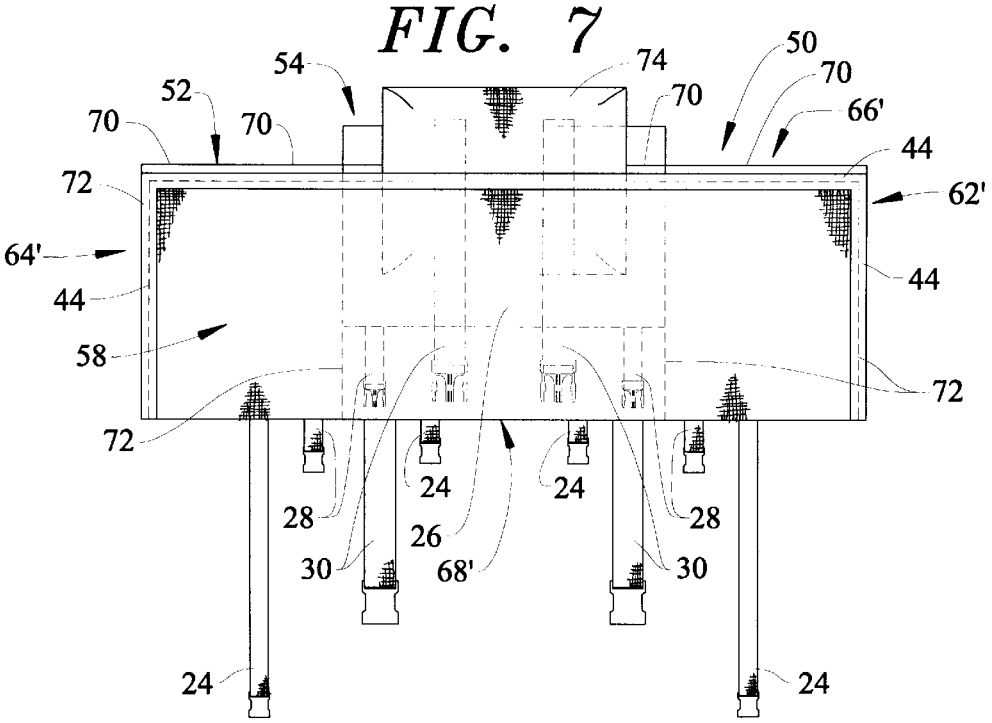
FIG. 7 is a rear perspective view of the secondary, pouch-forming panel construction of the present invention, showing the removable cushion and the shoulder straps and flap panel being inserted into a central pouch.

The absorbent surface 32 of the barrier construction 12 is characterized by releasable fastener material 46 that selectively engages a corresponding portion of releasable fastener material 48 disposed on the secondary panel construction 14, as shown in FIGS. 3 and 7. The interaction between these portions of fastener material 46,48 helps keep the device 10 folded into the sleeve orientation 16 as the primary panel construction 12 is rolled longitudinally to adjustably form the main compartment 20 of the backpack 18. It is noted that although hook-and-loop-type releasable fastener material, such as that available under the trademark VELCRO, is preferred, the panel constructions 12,14 may be joined with other types of releasable fasteners, including but not limited to, zippers, buttons, a drawstring assembly, or snaps.

The moisture-repellent second panel 38 is characterized by portions of releasable fastener material 42 positioned to cooperate with corresponding portions of releasable fastener material 44 disposed on the secondary, pouch-forming panel construction 14, as shown in FIGS. 3 and 7, respectively. The interaction between these portions of fastener material 42,44 facilitates detachable connection of the primary panel construction 12 and the secondary panel construction 14.

Figure 6:
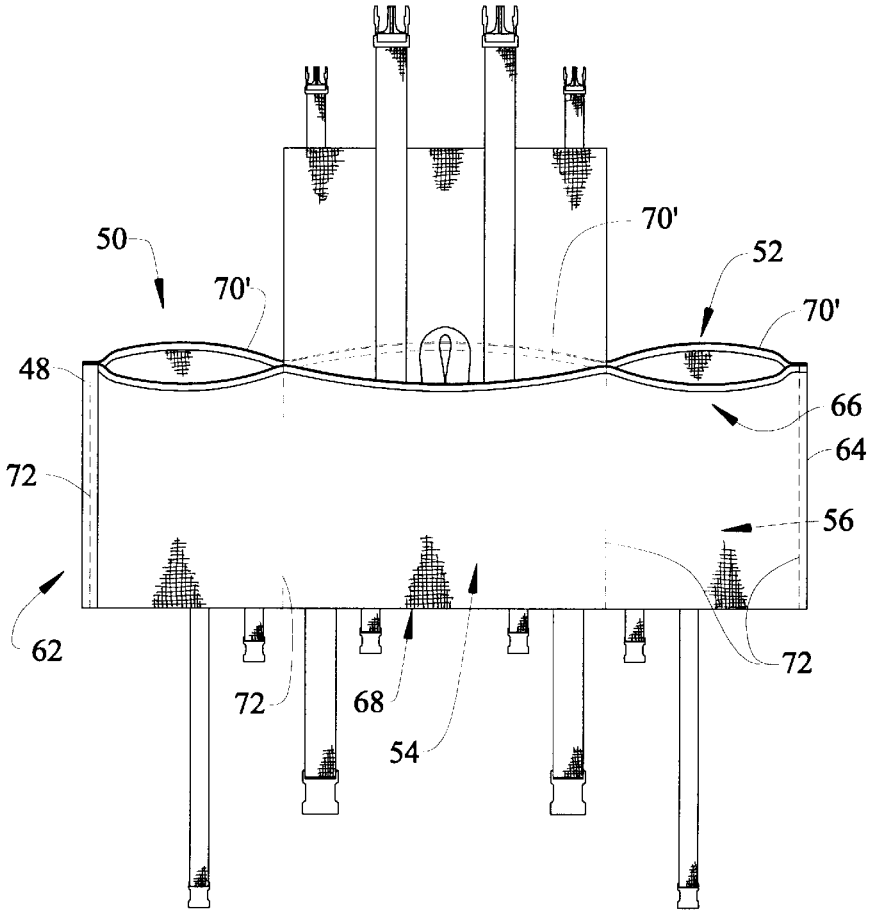
FIG. 6 is a front perspective view of the secondary, pouch-forming panel construction of the present invention.

With additional reference to FIGS. 6 and 7, the secondary, pouch-forming panel construction 14 is multi-sectioned, having a first side compartment or pouch 50 spaced apart from a second side pouch 52 by a central pouch 54. In a preferred embodiment, the pouch-forming panel construction 14 includes a first panel 56 placed against a second panel 58. The first and second panels 56,58 are substantially congruent, and the borders thereof are stitched together along three sides. In a preferred embodiment, the secondary, pouch-forming construction 14 includes two panels 56,58 of moisture-repellent material superimposed one against another to form a two-layer fabric rectangle. The preferred material is nylon or other similar moisture-repellent material, but other materials may suffice. Each panel 56,58 is characterized by a first side edge 62,62' spaced apart from a second side edge 64,64', by a top or first end edge 66,66' and a bottom or second end edge 68,68' extending therebetween. Corresponding panel first side edges 62,62', second side edges 64,64', and second end edges 68,68' are sewn together, and the first end edges 66, 66' are selectively secured together by mating portions of releasable fastener material 70,70' disposed therebetween. The panels 56,58 need not be sewn together; releasable attachment methods may also be used. Although hook-and-loop-type releasable fastener material, such as that available under the trademark VELCRO, is preferred, other types of releasable fasteners may also suffice, including but not limited to, zippers, buttons, or snaps. Other attachment methods, including but not limited to, heat welding, adhesives, and releasable attachment methods may also be used. It is noted that the secondary panel construction 14 may be fitted with insulation, such as foam or other similar temperature-maintaining material.

In keeping with the objectives of the present invention, the releasable nature of attachment of the secondary panel construction 14 to the primary panel construction 12 allows groups of related items to be placed in the pouches 50,52,54 for simultaneous attachment and removal, as desired. With this arrangement, interchangeable second panel constructions 14 may filled and alternately attached to the primary panel construction 12, in accordance with a chosen destination.

When the secondary panel construction 14 is disposed against the primary panel construction 12, the primary panel construction first side edge 13 and second side edge 15 are substantially aligned with the secondary panel construction first side edges 62,62' and second side edges 64,64', respectively. In turn, the sleeve orientation 16 noted above is formed by folding the primary and secondary panel constructions 12,14, in unison, into an overlapping arrangement in which the panel first the side edges 13,62,62' and second edges 15,64,64' line up with one another, thereby forming an overlapping seam 21 that is substantially aligned with a longitudinal center axis 17 of the primary panel construction 12. In a preferred embodiment, the edges 15,64,64' produce an overlap that is approximately one inch wide. The sleeve 16 may then be manipulated to produce the compartment-floor-producing rolled portion 22. With this arrangement, the main internal compartment 20 can be adjusted from relatively-tall, to accept elongated cargo, to relatively-squat, for more compact cargo. Additionally, items may be placed within the rolled section 22 for additional protection and insulation. It is noted that the floor of the main compartment 20 need not be formed by a rolled portion 22; the tube-like sleeve 16 may be folded, cinched with a drawstring assembly, or truncated with any number of adjustable members, including zippers, buttons, and snaps, not shown.

In a preferred embodiment, the roll-securing straps 24, flap-securing straps 28, shoulder straps 30 are preferably two-piece assemblies including adjustable, fabric straps and securing buckles. However, single-piece versions of these straps 24,28,30 may suffice.

As noted above, the area between the first and second panels 56,58 is divided into three compartments or pouches 50,52,54. In a preferred embodiment, the pouches 50,52,54 are bordered by lines of stitching 72 that extend through both panels 56,58 and span from the panel top edges 66,66' to the panel bottom edges 68,68'. Although lines of stitching 72 are preferred, other dividing methods would also suffice, including but not limited to, snaps, buttons, and zippers.

As seen in FIG. 6, the above-mentioned flap panel 26 extends from between the pouch-forming construction top edges 66,66' and has a width and height that is substantially equal to those of the central pouch 54. As a result, the flap panel 26 may be conveniently tucked into the central pouch 54 and stored therein. This flap storing feature is especially helpful when the device 10 is used as a chair protector or as a mat. The central pouch 54 also accommodates portions of the shoulder straps 30 and allows removable insertion of a pillow or cushion 74. During use, the pillow 74 will cushion an individual's head, making resting against on the device 10 comfortable, even if the flap panel 26 and shoulder straps 30 have been inserted within the central pouch 54.

In keeping with the objects of the present invention, the device 10 may be alternately placed in several orientations. As discussed above, and shown in FIGS. 1 and 2A, the device 10 may be used as a backpack with an adjustable main compartment 20 and a collection of pouches 50,52,54. As also noted above, the device 10 may be used as a seat cover, shown in FIG. 4, and as a protective mat, shown in FIG. 5.

When the present invention is used as a seat cover, the primary, barrier construction 12 and secondary, pouch-forming construction 14 produce synergistic results. As noted above, and as seen in FIG. 7, the pouch-forming construction second panel 58 includes releasable fastener material 44 to facilitate removable attachment to the primary, barrier construction 12. More particularly, the pouch-forming construction second panel 58 includes releasable fastener material 44 disposed along the panel top edge 66' and the panel side edges 62',64'. The panel bottom edge 68' may also be releasably attached to the barrier construction 12. With the secondary panel side and top edges 62',64',66' attached to the primary panel construction 12, the secondary panel construction 14 cooperatively forms a seat-top-engaging cap 76 with the primary panel construction. In a preferred embodiment, the cap 76 is a scoop-like pocket. With continued reference to FIGS. 4 and 4A, when used as a seat cover, the barrier construction 12 is placed against the support surfaces 78 of a seat 80, as in a car or chaise lounge, for example. The upper portion 82 of the seat 80 is inserted into the seat-top-engaging cap 76, thereby positioning the secondary panel construction behind the seat 80. Once the device 10 is in place with respect to a selected seat 80, the pouch-forming construction first side edges 62,62' and second side edges 64,64' are cinched together by one of the flap securing straps 28 that has been oriented to cross laterally behind the protected seat 80 to engage and opposite buckle 28' and tightened to remove slack. With this arrangement, the absorbent surface 32 of the barrier construction is maintained toward an individual, not shown, and the moisture-repellent surface 34 is oriented toward the support surfaces 78 of the protected seat 80. As a result, an individual who is sweaty from sports or is otherwise wet, may sit on the protected seat 80 without fear of damaging the seat. For large seats 80 or when it is desirable to rest against the included cushion 74, the secondary panel may be placed in front of the seat upper 82; the adjustable strap 28 may still be passed behind the seat to engage an opposite buckle 28'.

In keeping with the objects of the present invention, and as noted above, the device 10 of the present invention is also well-suited for use as a mat, as shown in FIG. 5. The primary and secondary panel constructions 12,14 cooperate to allow an individual to remain dry when resting against damp surfaces, while selectively providing a cushion 74 upon which the individual may rest his head. In this embodiment, as seen in FIG. 5, the moisture-repellent surface 34 of the barrier construction 12 is oriented toward the ground 84 or other surface upon which an individual wishes to rest, and the absorbent surface 32 is oriented to face an individual, not shown, resting against the device. With this arrangement, the absorbent surface 32 will wick moisture away from the resting individual, while the moisture-repellent surface 34 will advantageously prevent unwanted additional moisture from reaching the individual or the individual's clothing.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. An adjustably-sized convertible bag, cover and protective barrier device comprising:

a flexible primary panel construction having a releasable fastening along an edge characterized by a first surface and an opposite second surface, said first surface being absorbent, and a said second surface being moisture-repellent, said primary panel construction adapted to be folded into a sleeve orientation, said sleeve orientation defining an interior compartment having a volume;

a flexible secondary panel construction releasably attached to said primary panel construction, said secondary panel construction having a first panel attached to a second panel, each of said panels including a first side edge spaced apart from a second side edge by a first end edge and a second end edge, said panels being joined together along said side edges and said second end edges, said joined side edges and said end edges having a releasable fastening, said first and second panels forming at least one pouch with an unjoined first end edge located therebetween;

said pouch and said primary panel construction cooperatively forming a releasable cap; and size adjustment means for selectively modifying said volume of said interior compartment including rolling said sleeve upon itself;

whereby said device may be selectively maintained in a bag orientation characterized by an adjustably-sized elongated sleeve, a cover orientation having a releasable cap, and a mat orientation.

2. The adjustably-sized convertible bag, cover and protective barrier device of claim 1, wherein:

said size adjustment means includes at least one securing strap on said secondary panel construction for adjustably maintaining a portion of said primary panel construction in a rolled orientation.

3. The adjustably-sized convertible bag, cover and protective barrier device of claim 1, further including:

at least one engagement member constructed and arranged on said secondary panel to allow an individual to carry said bag.

4. The adjustably-sized convertible bag, cover and protective barrier device of claim 3, wherein said least one engagement member includes at least one shoulder strap.

5. The adjustably-sized convertible bag, cover and protective barrier device of claim 1, further including:

a flap member on said secondary panel adapted to selectively close said interior compartment.

6. The adjustably-sized convertible bag, cover and protective barrier device of claim 5 further including:

securing means on said secondary panel for selectively maintaining said flap member in an interior compartment closing orientation.

7. The adjustably-sized convertible bag, cover and protective barrier device of claim 1, wherein said at least one pouch includes releasable fastener means for selectively securing said first end edge of said first panel against said first end edge of said second panel.

8. The adjustably-sized convertible bag, cover and protective barrier device of claim 1, further including a cap adjustment means on said secondary panel for selectively sizing said cap.

9. The adjustably-sized convertible bag, cover and protective barrier device of claim 1, wherein said primary panel construction is insulated.

10. The adjustably-sized convertible bag, cover and protective barrier device of claim 1, wherein said secondary panel construction is insulated.

11. The adjustably-sized convertible bag, cover and protective barrier of claim 1, wherein said at least one pouch accommodates a pillow member inserted therein.

12. The adjustably-sized convertible bag, cover and protective barrier device of claim 1, further including:

at least one shoulder strap constructed and arranged on said secondary panel to allow an individual to carry said bag; and a flap member on said secondary panel adapted to selectively close said interior compartment, said flap member being adapted for selective storage within said at least one pouch.

13. The adjustably-sized convertible bag, cover and protective barrier device of claim 1, wherein:

said secondary panel construction is permanently secured to said primary panel construction.

* * * * *